310-334 SR
5/31/83 XR 4,386,241

United States Patent [19] [11] 4,386,241
Maeda [45] May 31, 1983

[54] PIEZOELECTRIC LOUDSPEAKER

[75] Inventor: Kyoichi Maeda, Tokyo, Japan

[73] Assignee: Seikosha Co., Ltd., Tokyo, Japan

[21] Appl. No.: 177,599

[22] Filed: Aug. 13, 1980

[30] Foreign Application Priority Data

Aug. 16, 1979 [JP] Japan ..... 54-104438

[51] Int. Cl.[3] ..... H04R 17/00
[52] U.S. Cl. ..... 179/110 A; 310/334
[58] Field of Search ..... 179/110 A; 310/322, 310/324, 334

[56] References Cited

U.S. PATENT DOCUMENTS

| | | | |
|---|---|---|---|
| 2,607,858 | 8/1952 | Mason | 310/324 |
| 2,910,545 | 10/1959 | Glenn | 310/334 |
| 3,166,730 | 1/1965 | Brown, Jr. et al. | 310/334 |
| 3,588,381 | 6/1971 | Schafft | 179/110 A |
| 3,721,840 | 3/1973 | Yamada | 179/110 A |
| 4,283,605 | 8/1981 | Nakajima | 179/110 A |

*Primary Examiner*—George G. Stellar
*Attorney, Agent, or Firm*—Robert E. Burns; Emmanuel J. Lobato; Bruce L. Adams

[57] ABSTRACT

A piezoelectric loudspeaker comprises a support member having an opening therethrough in which is disposed a circular piezoelectric vibrator. The vibrator is secured at its periphery to the support member so as to be vibrationally driven in response to a driving signal applied thereto. A sound-producing vibratable member is secured at its periphery to the support member and is coupled to the piezoelectric vibrator at a central circular region which is concentric with the vibrator. The piezoelectric vibrator and the vibrating member are coupled together by means of a cylindrical coupling member which effectively transmits the vibrational movement of the vibrator to the vibratable member to effect vibration of the vibratable member over a wide frequency range including the low end of the audible range to produce a corresponding wide range of acoustic sounds.

6 Claims, 3 Drawing Figures

PIEZOELECTRIC LOUDSPEAKER

This invention relates to piezoelectric loudspeakers. It has, heretofore been known in the art to utilize a piezoelectric loudspeaker in which a simple piezoelectric element or a resilient thin plate provided with a piezoelectric element on at least one of the opposite surfaces thereof as a sound source. In this type of piezoelectric loudspeaker, the piezoelectric vibrator and a vibrating film, such as a cone paper, are coupled at a point or a position where the amplitude of vibration of the piezoelectric vibrator is maximum when it vibrates in the main resonance mode. Though there are various coupling structures in which the parts are coupled directly or through a rod or a wire, they are always coupled at one point in any case. According to such coupling structures, since the main resonance frequency and frequencies near the main frequency of the piezoelectric vibrator merely contribute to produce sounds and the impedance grows high in the range of the low frequency, it is very difficult to produce the low sound. Therefore, the piezoelectric loudspeaker heretofore in use has been limited to be solely utilized as a tweeter.

It is an object of this invention to provide a piezoelectric loudspeaker in which the sound pressure satisfactorily extends over a wide frequency range.

Another object of this invention is to provide an ultra thin piezoelectric loudspeaker that is suitable to be used in a portable miniature radio.

A further feature of this invention is that a vibrating film is coupled on a concentric circle with a circular piezoelectric vibrator which functions as a driving source.

Other features and advantages of the piezoelectric loudspeaker will be apparent from the following description of the invention, the appended claims and attached drawings in which;

Figure 1:
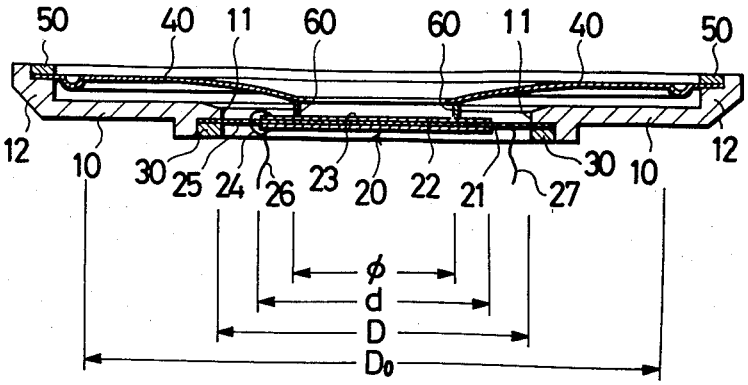
FIG. 1 is a cross section view of one embodiment of a piezoelectric loudspeaker according to this invention.

An embodiment of a piezoelectric loudspeaker according to this invention will be explained hereinunder referring FIG. 1. A discoid frame or support member 10 is provided with a circular opening portion 11 which is bored therethrough at its central portion and a projecting portion 12 which projects from a front surface of its peripheral portion. A circular piezoelectric vibrator 20 comprises a sound source and is located in the opening portion 11 and its peripheral portion is secured to an annular portion of the frame 10 at the opening portion 11 with a ring member 30. The piezoelectric vibrator 20 has a bimorph structure which is provided with a circular resilient metal thin plate 21 and circular piezoelectric elements 22 and 23 fixed on opposite surfaces of the plate 21 by means of an adhesive. For the piezoelectric elements 22 and 23, an inorganic material whose mechanical coupling coefficient is large, for example, a Rochelle salt, a barium titanate, a lead titanate girconate, a lead cobalt niobate or a lead bismuth niobate etc., is suitable. For the resilient thin plate 21, a material whose stiffness is sufficient, for example, a phosphor bronze or a stainless steel, is preferable. Each of the piezoelectric elements 22 and 23 is provided with a driving electrode (not shown) on its respective outside surface. Both of the driving electrodes are electrically connected to each other through a lead wire 24 passing through a small hole 25 which is bored through the resilient thin plate 21. Lead wires 26 and 27 for external connection are connected to the resilient thin plate 21 and the driving electrode of the piezoelectric element 22 respectively and a driving signal is applied to the lead wires 26 and 27. A vibratable member comprising a vibrating film or diaphragm 40 is secured at its periphery to the projection portion 12 with a ring member 50. The vibrating film 40 has an annular front shape and a gentle cone-shaped cross section, and the vibrating film 40 is coupled to the piezoelectric vibrator 20 through coupling means in the form of a cylindrical coupling member 60 which is positioned on a concentric circle with the piezoelectric vibrator 20, however, the vibrating film 40 may be directly coupled by the coupling means to the piezoelectric vibrator 20 on the concentric circle in some cases. For the vibrating film 40, a paper, a plastic film, a plastic film with an evaporated metal or a metal thin plate can be employed. By this construction, the central annular regions of the vibrator 20 and the vibrating film 40 are concentrically coupled together. For the cylindrical coupling member 60, any material can be employed but a light and stiff material is preferable.

According to the piezoelectric loudspeaker which is composed as described above, the vibration of the piezoelectric vibrator 20 is transmitted to the vibration film 40 through the cylindrical coupling member 60 and thus the acoustic sound is produced by virtue of the vibration of the vibrating film 40.

A comparison will now be given between the case in which the vibrating film 40 is coupled to the piezoelectric vibrator 20 through the cylindrical coupling member 60 such as in this invention and the case in which the former is coupled to the center of the latter such as the conventional device heretofore as in use. In the latter case, the vibration of the vibrator can be effectively transmitted to the vibrating film merely when the vibrator is operated in its main resonance mode, but the vibration of the vibrator is not instantly transmitted to the vibrating film when the vibrator is operated in its secondary resonance modes. On the contrary, in the former case of the present invention, even when the vibrator is operated in the secondary resonance modes, the vibration thereof can be transmitted far more effectively to the vibrating film in comparison with the latter case. In other words, in the piezoelectric loudspeaker, the sound pressure characteristic can be improved to grow satisfactory and flat extending over the wide range from the low frequency to the high frequency only by utilizing the coupling member such as in the former case.

Figure 2:
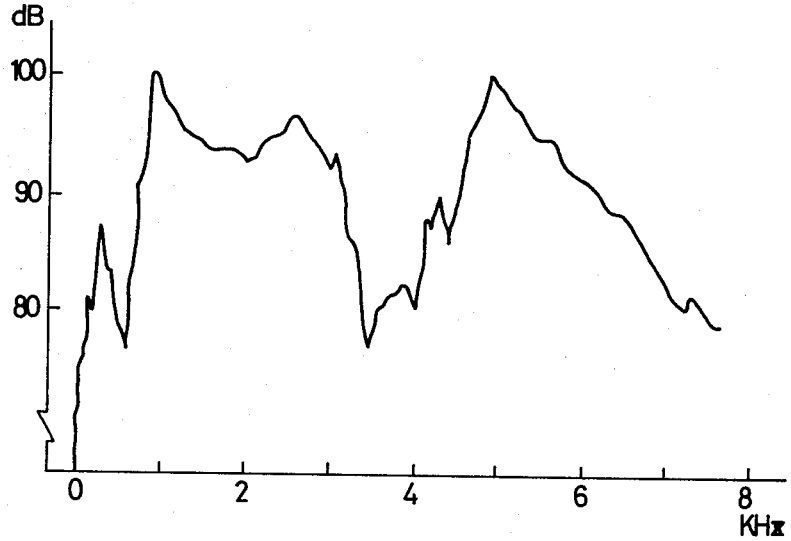
FIG. 2 is a frequency-sound pressure characteristic diagram relating the loudspeaker of FIG. 1.

In such a structure, the sound pressure characteristic is influenced also by the ratios d/D and $\phi$/d, in which D, d and $\phi$ are the respective diameters of the resilient thin plate 21, the piezoelectric elements 22 and 23, and the cylindrical coupling member 60. As a result of experiment, when the ratio d/D is in the range of 0.65 to 0.8, there are many secondary resonances having a comparative high level in the low frequency range and the main resonance frequency drops comparatively down. Further, when the ratio $\phi$/d is in the range of 0.65 to 0.8, the vibration of the piezoelectric vibrator 20 can be transmitted evenly to the vibrating film 40 extending over the wide frequency range. For an example, when the resilient thin film 40 is a phosphor bronze plate which has a diameter of 27 mm and a thickness of 0.05 mm, each of the piezoelectric elements 22 and 23 is a lead cobalt niobate which has a diameter 20 mm and a thickness of 0.12 mm, and the vibrating film 40 is a cone paper which has an effective diameter of 50 mm, the frequency-sound pressure characteristic is shown in FIG. 2 when the input signal is a sine curve wave whose effective voltage is 1 volt and the measuring point is 9 cm from the front surface of the frame 10 on its center line.

Figure 3:
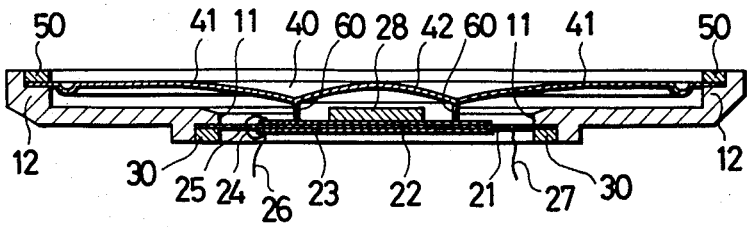
FIG. 3 is a cross section view of a second embodiment of the piezoelectric loudspeaker according to this invention.

FIG. 3 shows a second embodiment, in which the piezoelectric vibrator 20 is provided with an adjusting mass 28 on its central portion, the vibrating film 40 is provided with a dome portion 42 in addition to a cone portion 41. By selectively locating the adjusting mass 28 on the central portion of the piezoelectric vibrator 20, the frequencies of the main and secondary resonance modes of the piezoelectric vibrator 20 can be reduced and thus the whole of the response frequency of the piezoelectric vibrator 20 can be improved. Further, by providing the dome portion 42 at the central part of the vibrating film 40, the sound pressure of the high frequency range can be elevated.

Moreover, in the first and second embodiments, the vibrating film 40 may have a peripheral shape of an oval other than a circle, and the piezo-electric vibrator 20 may have an unimorph structure.

According to the above-described piezoelectric loudspeaker of this invention, since the vibrating film 40 for producing the acoustic sound is coupled to the piezoelectric vibrator 20 on the desired concentric circle therewith, the vibration of the vibrator can be transmitted effectively and evenly to the vibrating film not only in the main resonance mode but also in the secondary resonance modes. Therefore, a satisfactory output sound pressure can be obtained extending over the wide range from the low frequency to the high frequency, and thus even the piezoelectric loudspeaker can have a characteristic which compares quite well with the usual dynamic loudspeaker and the output sound is soft. Furthermore, it can be manufactured as an ultra thin type at a low cost and it is very suitable to utilize for a thin type portable radio or a miniature cassette recorder.

What I claim is:

1. A piezoelectric loudspeaker comprising: a support member having an opening therethrough; a generally circular piezoelectric vibrator disposed in said opening and being secured at its peripheral portion to said support member to enable the vibrator to be vibrationally driven during use of the piezoelectric loudspeaker; means for applying a driving signal to the piezoelectric vibrator to vibrationally drive the same over a wide frequency range; a vibratable member spaced from the vibrator and being secured at its peripheral portion to said support member to enable the vibratable member to undergo vibrational movement; and coupling means including a cylindrical coupling member for coupling a central annular region of said vibratable member to a central annular region of said vibrator to transmit vibrational movement of said vibrator to said vibratable member to thereby effect vibration of said vibratable member over a wide frequency range to produce a corresponding wide range of acoustic sounds.

2. A piezoelectric loudspeaker comprising: a support member having an opening therethrough; a generally circular piezoelectric vibrator disposed in said opening and being secured at its peripheral portion to said support member to enable the vibrator to be vibrationally driven during use of the piezoelectric loudspeaker, the piezoelectric vibrator comprising a generally circular thin resilient plate secured at its peripheral portion to said support member, and a piezoelectric element affixed to at least one of the surfaces of the plate; means for applying a driving signal to the piezoelectric vibrator to vibrationally drive the same over a wide frequency range; a vibratable member spaced from the vibrator and being secured at its peripheral portion to said support member to enable the vibratable member to undergo vibrational movement; coupling means for coupling a central annular region of said vibratable member to a central annular region of said vibrator to transmit vibrational movement of said vibrator to said vibratable member to thereby effect vibration of said vibratable member over a wide frequency range to produce a corresponding wide range of acoustic sounds; and an adjusting mass disposed on the piezoelectric vibrator inside of the central annular region thereof for effectively reducing the frequencies of the main and secondary resonance modes of the piezoelectric vibrator.

3. A piezoelectric loudspeaker according to claim 2; wherein the coupling means comprises a cylindrical coupling member.

4. A piezoelectric loudspeaker according to claim 2; wherein the ratio d/D is in the range of 0.65 to 0.8, where d and D are the respective diameters of the piezoelectric element and of the resilient thin plate.

5. A piezoelectric loudspeaker according to claim 2; wherein the ratio $\phi/d$ is in the range of 0.65 to 0.8, where $\phi$ and d are the respective diameters of the annular region and of the piezoelectric element.

6. A piezoelectric loudspeaker according to claim 1 or 2; wherein the vibratable member has a central dome-shaped portion.

* * * * *